US006761781B1

(12) United States Patent
Lawrence et al.

(10) Patent No.: US 6,761,781 B1
(45) Date of Patent: Jul. 13, 2004

(54) HIGH DENSITY ANFO

(75) Inventors: Lawrence D. Lawrence, Sandy, UT (US); Richard H. Granholm, Sandy, UT (US)

(73) Assignee: Dyno Nobel Inc., Salt Lake City, UT (US)

( * ) Notice: Subject to any disclaimer, the term of this patent is extended or adjusted under 35 U.S.C. 154(b) by 331 days.

(21) Appl. No.: 09/472,800

(22) Filed: Dec. 28, 1999

Related U.S. Application Data

(63) Continuation-in-part of application No. 08/986,150, filed on Dec. 5, 1997, now abandoned.

(51) Int. Cl.[7] ..... C06B 31/28
(52) U.S. Cl. ..... 149/46
(58) Field of Search ..... 149/46

(56) References Cited

U.S. PATENT DOCUMENTS 3,966,853 A * 6/1976 Osako et al. ..... 149/46
4,714,503 A * 12/1987 Cescon et al. ..... 149/46
4,758,289 A * 7/1988 Sudweeks ..... 149/109.6
5,041,177 A * 8/1991 Hajto et al. ..... 146/46
5,078,813 A * 1/1992 Tucker et al. ..... 149/46
5,431,757 A * 7/1995 Petterson et al. ..... 149/109.6
5,456,775 A * 10/1995 Schapira et al. ..... 149/46
5,480,500 A * 1/1996 Richard et al. ..... 149/109.6
5,578,788 A * 11/1996 Engsbraten ..... 102/301
5,925,846 A * 7/1999 Richard et al. ..... 102/289
6,113,714 A * 9/2000 Richard et al. ..... 149/109.6

OTHER PUBLICATIONS

Hawley, "The Condensed Chemical Dictionary", 9$^{th}$ Ed., (1977), Van Nostrand Reinhold Company, New York, pp. 583, 634.*

* cited by examiner

*Primary Examiner*—Edward A. Miller

(57) ABSTRACT

The present invention relates to a high density ammonium nitrate-fuel oil ("ANFO") blasting composition comprising an organic liquid fuel and porous prilled ammonium nitrate of high bulk density, small particle size and good oil absorption capacity.

4 Claims, No Drawings

HIGH DENSITY ANFO

This application is a continuation-in-part of application Ser. No. 08/986,150, filed Dec. 5, 1997 now abandoned.

The present invention relates to a high density ammonium nitrate-fuel oil ("ANFO") blasting composition comprising an organic liquid fuel and porous prilled ammonium nitrate of high bulk density, small particle size and good oil absorption capacity. By "high density" in the previous sentence is meant a poured bulk density of from about 0.90 to about 1.05 g/cc.

BACKGROUND OF THE INVENTION

ANFO blasting compositions are the most widely-used explosives in the world today. They are relatively simple to manufacture and are comprised of basically two commercially available components: porous prilled ammonium nitrate ("AN") and organic liquid fuel such fuel oil or diesel fuel. The AN and fuel oil are mixed generally in a stoichiometric weight ratio of 94% AN and 6% fuel oil, and in fact, porous prilled AN ("PPAN") is conveniently capable of absorbing about 6% fuel oil. Although ANFO is relatively insensitive and thus safe to handle, it becomes a powerful blasting composition once it is properly initiated. Nevertheless, it has certain disadvantages in blasting applications.

One disadvantage is that ANFO is water-soluble and thus cannot be used reliably in water-containing boreholes unless it is packaged or otherwise segregated from water. Due to the size and porosity of the prills, ANFO has a relatively low bulk density of about 0.85 g/cc. This makes packaged ANFO difficult to use in water-filled boreholes because of the relative bulk densities and the tendency of the packaged ANFO to float in water. The low bulk density of ANFO also can be disadvantageous where explosives having higher energy densities are desired for particular blasting applications.

Efforts have been made to increase the density of ANFO-type blasting compositions. AN or ANFO prills have been combined with a liquid matrix such as an emulsion phase to form a "heavy ANFO." The liquid matrix complicates, however, the manufacturing of the blasting composition since a stable emulsion first must be manufactured. Other higher density materials or components have been added to ANFO in an effort to increase its density. For example, aluminum particles have been added to increase both bulk and energy density. A different approach involved the pneumatic ejection and packing of ANFO into a borehole, although this resulted in a packing density of only about 0.94 g/cc.

Another approach has been to use high density AN prills ("HDAN"), rather than low density, porous AN prills (PPAN). High density AN prills (HDAN) are commonly referred to as agricultural grade and are used primarily as fertilizer. They are manufactured by a different process than that used to make low density, porous AN prills and consequently the high density prills are considerably less porous and have insufficient oil absorption capacity for use effectively in an ANFO blasting composition.

Efforts also have been made to improve the oil absorption capacity of high density prills. U.S. Pat. No. 4,736,683 describes these efforts and itself describes a further effort comprising the addition of a high molecular weight polymer to improve fuel retention of the fuel on high density AN particles. Related U.S. Pat. Nos. 5,486,246 and 5,527,498 disclose a porous AN matrix, and a method for making the matrix, of higher density than porous AN prills and having a "high" oil absorption capacity. The method involves adding an internal additive and an external coating to the high density prills.

The high bulk density, porous prilled AN ("HBDPPAN") of the present invention has comparable, if not superior, oil absorption capacity to standard PPAN and does not require the addition of polymers or of special additives or coatings in order to improve polymers or of special additives or coatings in order to improve oil retention properties. By. "high bulk density" is meant a poured bulk density of from about 0.9 to about 1.0 g/cc.

During the manufacturing and handling of PPAN, a small percentage of "fines" are generated. These fines are small diameter particles that have a higher bulk density than PPAN and generally contain a relatively higher weight percentage of the anti-caking additives that are present in PPAN. These fines tend to destabilize an emulsion phase and thus normally are separated from the PPAN and sold for less value as AN fertilizer. It has been found in the present invention, however, that these fines actually function as HBDPPAN in ANFO. Their small particle size contributes to their high bulk density. Their porosity and thus oil absorption capacity results from their method of manufacture, which method of course is the same as the method for manufacturing PPAN, and from the increased surface area of the smaller prills. Thus another advantage of the present invention is the more beneficial use of fines.

SUMMARY OF THE INVENTION

The invention comprises a higher density ANFO blasting composition comprising an organic liquid fuel and HBDPPAN having a particle size of less than about 1.2 mm and an oil absorption capacity of greater than 5%. Preferably, the HBDPPAN comes from fines generated during the manufacturing or handling of PPAN.

DETAILED DESCRIPTION OF THE INVENTION

The process for manufacturing PPAN is well known. The prills are obtained by spraying droplets of a concentrated (about 95%) ammonium nitrate solution from the top of a prilling tower. As the droplets fall against a rising current of cooler air, they solidify into the familiar prilled form. As a result of water evaporation during the solidification process in the tower and subsequent drying of the prill in a drying train, voids are formed in the solidified prills, thereby imparting low density and oil absorption capacity. The prills then go through various anti-caking coating and screening steps.

The typical PPAN has a particle size range of about 1.4 to 3.0 mm and an oil absorption capacity of about 6%. This particle size is desirable because larger prills would tend to dry too slowly in the process and smaller-sized prills would require more anti-caking coating material because of their larger total surface area. During the manufacturing process and subsequent handling procedures, a small amount of fines are generated. (generally up to about 5% by weight). These fines heretofore have been considered undesirable and generally have been recycled or sold as fertilizer rather than used as PPAN. We now have found that these fines comprise HBDPPAN that can be effectively used to make high density ANFO. If desired, the manufacturing process could be tailored to generate a larger quantity of HBDPPAN.

A comparison of approximate particle sizes of HBDPPAN, PPAN and HDAN is shown in Table 1, and a comparison of densities and oil absorption capacities is shown in Table 2.

As can be seen in Table 1, the particle size range of HBDPPAN is much smaller than PPAN and common HDAN and extends into a much smaller range than even HDAN Sherritt Miniprills.

Table 2 compares the detonation results of ANFO blasting compositions made with PPAN, HBDPPAN and HDAN. Table 2 also compares the bulk densities of these compositions and the oil absorption capacities of the various prill types. Example 1 contained HBDPPAN and had superior detonation results to both Example 2 (PPAN) and Examples 3 and 4 (HDAN). The HBDPPAN in Example 1 had a considerably higher oil absorption capacity than the high density prills (HDAN) and even exceeded the capacity of the PPAN. The poured and settled bulk densities of Example 1 were significantly higher than those of Example 2 (PPAN) and were even higher than Examples 3 and 4 (HDAN). The HBDPPAN used in Example 1 were fines generated during the manufacture of the PPAN used in Example 2, and when used to make an ANFO blasting composition, they clearly were superior not only to high density AN prills but also to PPAN. Thus the HBDPPAN makes a superior high density ANFO blasting composition.

The HBDPPAN used in Example 1 contained an anti-caking additive comprising a surfactant coating carried in an oil-wax matrix. It was present in an amount of about 0.2% by weight of the prills, as compared to about 0.1% in the PPAN in Example 2. Anti-caking additives for the HBDPPAN may be selected from any of the AN prill coatings well-known in the art. Some examples are: talc; clay; stearic acid or derivatives; surfactants carried in an oil-wax matrix such as fatty amines, fatty acids, and fatty acid salts; and other sufactants such as alkylnaphthalene sulfonates. These coatings generally are used in amounts of a few tenths of a percent or less, but any of them, alone or in combination, may be present in an amount of up to several percent by weight of the HBDPPAN.

The organic liquid fuels for use in the compositions of the invention can be aliphatic, alicyclic, and/or aromatic and can be saturated and/or unsaturated, so long as they are liquid at the formulation temperature. Preferred fuels include tall oil, mineral oil, waxes, paraffin oils, toluene, xylenes, mixtures of liquid hydrocarbons generally referred to as petroleum distillates including diesel fuels, and vegetable oils such as corn oil, cotton seed oil, peanut oil, and soybean oil. Particularly preferred liquid fuels are mineral oil, No. 2 fuel oil, paraffin waxes, microcrystalline waxes, and mixtures thereof. Aliphatic and aromatic nitrocompounds and chlorinated hydrocarbons also can be used. Mixtures of any of the above can be used.

Various internal additives frequently are added to the AN solution before prilling to enhance the physical stability of PPAN. These can be either organic or inorganic in nature and are present in amounts generally of less than 1% by weight. Such additives do not materially affect the performance of HBDPPAN in this invention. Typical organic additives are alkylnaphthalene sulfonates or derivatives thereof. Typical inorganic additives are various sulfate salts, such as ammonium sulfate or aluminum sulfate, phosphate salts, borates and the like.

The oil absorption capacity for the. HBDPPAN should be at least about 5% by weight of the prill or greater. The oil absorption capacity is measured by adding No. 2 fuel oil to the AN prills until the oil no longer absorbs into the prills but remains "wet" on the surface of the prills. Alternatively, the prills may be submersed in No. 2 fuel oil, and then the oil is allowed to drain off completely. The prill sample is reweighed to determine the weight percent of oil that absorbed into the prills.

While the present invention has been described with reference to certain illustrative examples and preferred embodiments, various modifications will be apparent to those skilled in the art and any such modifications are intended to be within the scope of the invention as set forth in the appended claims.

TABLE 1

AN Particle Sizes

| Typical Particle Size Ranges: | | | |
|---|---|---|---|
| PPAN | HBDPPAN | ElDorado E2 HDAN Prills | HDAN Sherritt Miniprills |
| 1.4–3.0 mm | <1.2 mm | 1.5–3.0 mm | 0.5–1.4 mm |

HBDPPAN and Sherritt Miniprill Particle Size Distribution:

| U.S. Sieve Size | Particle Size (mm) | HBDPPAN % in Fraction | Sherritt Miniprill % in Fraction |
|---|---|---|---|
| −10 + 12 | −2.00 + 1.70 | 0.3 | 0 |
| −12 + 14 | −1.70 + 1.40 | 0.4 | 0.3 |
| −14 + 16 | −1.40 + 1.168 | 0.4 | 21.2 |
| −16 + 20 | −1.168 + 0.833 | 60.4 | 58.2 |
| −20 + 30 | −0.833 + 0.589 | 5.6 | 16.8 |
| −30 + 40 | −0.589 + 0.420 | 5.5 | 3.0 |
| −40 + 60 | −0.420 + 0.250 | 6.8 | 0.1 |
| −60 + 100 | −0.250 + 0.147 | 7.0 | 0 |
| −100 | −0.147 | 13.7 | 0.3 |

TABLE 2

| | Example 1 HBDPPAN ANFO | Example 2 PPAN ANFO | Example 3 ElDorado E2 HDAN ANFO | Example 4 Sherritt Miniprills HDAN ANFO |
|---|---|---|---|---|
| Detonation Velocities at 20° C. (km/s): | | | | |
| Density (g/cc): | 1.0 | 0.85 | 1.0 | 1.0 |
| Diameter (mm) | | | | |
| 100 | 3.6 | 2.1 | fail | fail |
| 75 | 3.0 | fail | — | — |
| 63 | 2.6 | — | — | — |
| 50 | fail | — | — | — |
| Minimum Booster: | | | | |
| 75 mm (det/fail) | 4½ g/#12 | fail | fail | fail |
| Oil Absorption (wt. %): | 11.0 | 6.1 | 1.5 | 2.0 |
| Bulk Density (94% AN, 6% Fuel Oil): | | | | |
| Poured (g/cc) | 0.97 | 0.89 | 0.88 | 0.95 |
| Settled (g/cc) | 1.12 | 0.92 | 1.05 | 1.05 |

We claim:

1. Am ammonium nitrate-fuel oil blasting composition having a poured bulk density of from about 0.90 to about 1.05 g/cc and consisting essentially of an organic liquid fuel selected from the group consisting of mineral oil, diesel fuels and mixtures thereof and porous prilled ammonium nitrate having a poured bulk density of from about 0.9 to about 1.0 g/cc, a particle size of less than about 1.2 mm and an oil-absorption capacity of greater than about 5%.

2. A blasting composition according to claim 1 wherein the ammonium nitrate contains an anticaking coating.

3. A blasting composition according to claim 1 containing an internal additive to enhance the physical stability of the prilled ammonium nitrate.

4. A blasting composition according to claim 1 wherein the ammonium nitrate comprises small diameter, porous particles generated in small percentage during the manufacturing or handling of low density porous prilled ammonium nitrate.

* * * * *